United States Patent [19]

Zavodszky

[11] 4,412,579

[45] Nov. 1, 1983

[54] APPARATUS FOR HANDLING A CONTINUOUS CASTING MACHINE STARTER BAR

[75] Inventor: Tamas Zavodszky, Pittsburgh, Pa.

[73] Assignee: Koppers Company, Inc., Pittsburgh, Pa.

[21] Appl. No.: 376,019

[22] Filed: May 7, 1982

[51] Int. Cl.[3] ..... B22D 11/16; B22D 11/08

[52] U.S. Cl. ..... 164/413; 164/426; 164/446

[58] Field of Search ..... 164/413, 425–426, 164/445–446, 454, 483

[56] References Cited

U.S. PATENT DOCUMENTS

| | | | |
|---|---|---|---|
| 3,344,844 | 10/1967 | Reinfeld | 164/426 |
| 3,542,118 | 11/1970 | Rossi | 164/426 |
| 3,608,620 | 9/1971 | Bollig | 164/426 |
| 3,628,595 | 12/1971 | Mitchell | 164/416 |
| 3,814,169 | 6/1974 | Knell | 164/426 |
| 3,823,763 | 7/1974 | Hofmann | 164/426 |
| 3,930,533 | 1/1976 | Rokop | 164/426 |
| 4,150,710 | 4/1979 | John | 164/483 |

FOREIGN PATENT DOCUMENTS

| | | | |
|---|---|---|---|
| 2714338 | 10/1978 | Fed. Rep. of Germany | 164/425 |

*Primary Examiner*—Gus T. Hampilos
*Assistant Examiner*—Richard K. Seidel
*Attorney, Agent, or Firm*—Daniel J. Long; Herbert J. Zeh, Jr.

[57] ABSTRACT

A continuous metal casting machine having a starter bar handling apparatus which includes a first pivoting arm member generally suspended over the downwardly oriented, generally arcuate strand conveying structure and a second pivoting arm member generally suspended over the upwardly oriented, generally arcuate starter bar receiving structure. Releaseable starter bar engagement means are mounted on the terminal ends of these pivoting arms so that as the first arm pivots downwardly through a vertical arc generally coplanar with the strand conveying structure, the starter bar is moved from the mold to the straightener apparatus. A guide structure or other such control means is mounted in the path of the first arm member so that its terminal engagement means will release the starter bar as it is engaged by the straightener apparatus. As the starter bar is discharged from the straightener apparatus it will then be engaged by the second pivoting arm member and be withdrawn by movement of that arm member to an upper position on the starter bar receiving structure.

15 Claims, 10 Drawing Figures

APPARATUS FOR HANDLING A CONTINUOUS CASTING MACHINE STARTER BAR

BACKGROUND OF THE INVENTION

1. Field of the Invention

The present invention relates to machines for the continuous casting of metal and, in particular, to systems for handling starter bars which are usually incorporated into such machines.

2. Description of the Prior Art

As is, for example, disclosed in U.S. Pat. No. 3,344,844, molten metal may be continuously cast by pouring it into a flow through type casting mold so as to form an elongate continuous strand of metal. In order to start this strand the mold is initially closed at its lower end with a starter bar and molten metal is allowed to solidify and become fastened to the starter bar. The starter bar is then withdrawn from the mold so that a strand of solidifying metal is formed from the mold along a generally arcuate, downwardly extending path which is defined by a plurality of rollers which may be supported on an apron structure. At the base of this structure, the strand enters a set of straightener pinch rollers through which it passes and emerges as a straightened horizontal casting. Before the strand is straightened, however, the starting bar must be first disconnected and stored, often on a curved starting bar receiving structure that is positioned adjacent the discharge end of the straightener apparatus and above straightened casting.

Various means have been suggested for moving the starting bar, first through its initial downward path, then through the straightener apparatus, and then onto the starting bar receiving structure. In certain designs such movement of the starting bar is accomplished by one or more drive rolls in the straightener apparatus. Starter bar handling mechanisms built according to these designs, however, may often have certain disadvantages. The starter bar, for example, may eventually become deformed by such mechanisms due to the continuous pressure exerted on it by the rollers. Undue wear on the rollers may also result. Further, in such designs the rollers are often powered by two or more direct current electric motors which may have to be mounted in close proximity to the hot strand and which usually must be synchronized with one another to prevent damage to the strand. Other designs employ a single elevated pivoting arm to move the starter bar along its downward arcuate path, through the straightener apparatus and then onto its receiving structure. While such designs appear to alleviate some of the above mentioned problems, some difficulties may still attend their use. It is, therefore, the object of the present invention to provide a mechanism which effectively handles the starter bar without causing undue deformation or damage to the strand and which may be powered by a single drive means positioned remotely from the hot strand.

SUMMARY OF THE INVENTION

The present invention consists of a starter bar handling mechanism having two separate pivoting arms. A first arm is suspended above the straightener apparatus so as to move in a vertical arc which is substantially coplanar with the downward arcuate path of the starter bar from the mold to the straightener apparatus. This arm is removeably connected at its terminal end to the starter bar so that it provides the means for displacing the starter bar from the mold to the straightener apparatus. When the starter bar is engaged by the straightener apparatus, the first pivoting arm disengages from it, and the starter bar is moved by the pinch rollers in the straightener apparatus toward its receiving structure where it is engaged by a second pivoting arm which removes it to its stored positioned. By a reverse action of the above described apparatus the starter bar may be returned to the mold.

BRIEF DESCRIPTION OF THE DRAWINGS

The present invention is further described in the accompanying drawings in which.

DETAILED DESCRIPTION

Figure 1:
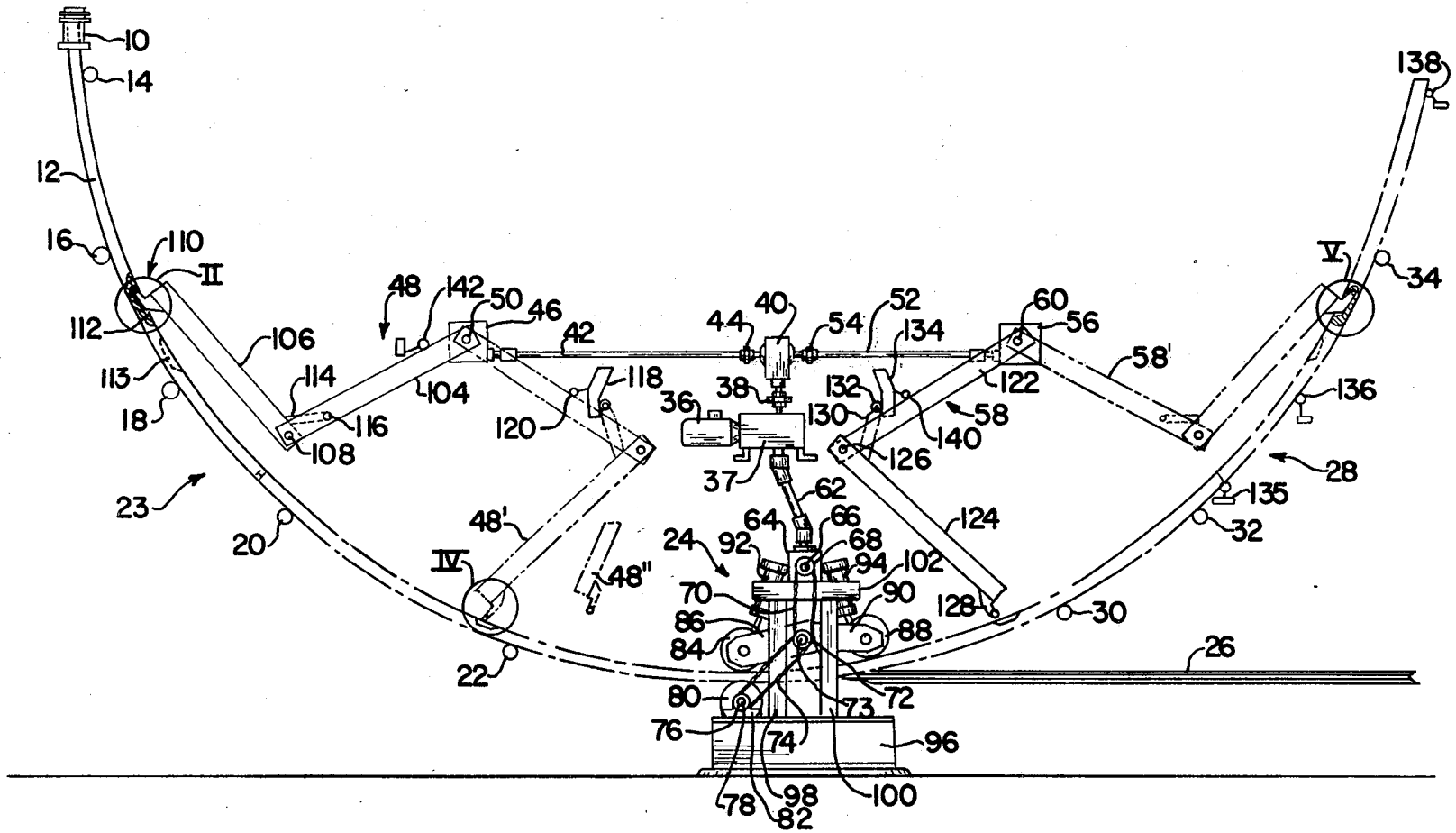
FIG. 1 is a schematic elevational view of a continuous casting machine incorporating a preferred embodiment of the present invention.

Referring to FIG. 1 a flow through mold is shown at numeral 10. Conventional mold support, oscillation and spray means are provided below the mold but, for the sake of clarity, are not shown. A starter bar 12 is shown inserted in the mold 10. A plurality of guide rollers as at 14, 16, 18, 20, and 22 define a downward, generally arcuate strand conveying structure shown generally at numeral 23. This strand conveying structure has a lower discharge end oriented in a substantially horizontal direction so as to convey the starter bar and the strand from the mold to a straightener apparatus which is shown generally at numeral 24. Extending laterally from the discharge end of the straightener apparatus is a casting take-off table 26, and curving upwardly and away from this discharge end is a starting bar receiving structure 28 which includes guide rollers 30 32 and 34. It will be understood that the above described rollers and the casting take-off table are retained on a conventional supporting structures, which for the sake of clarity, are not shown in the drawings. It will also be understood that the apparatus, to the extent it has been described in this paragraph, is conventional and does not, in itself, constitute the present invention.

The present invention resides in the illustrated mechanism for handling the starter bar 12. This mechanism includes a main drive means 36 which is preferably an alternating current electric motor. Drive means 36 is connected to reduction gearing 37, coupling 38 and a second gear box 40 so as to rotate a horizontal shaft 42.

Electrical clutch 44 is provided to selectively stop rotation of this shaft when, as is described below, the motor 36 is being used to drive other elements of the apparatus. The rotational motion of the shaft 42 is transferred through a reducing and selective braking apparatus 46 to drive a first arm, shown generally at numeral 48, which pivots through a vertical arc on a pivoting shaft 50. The vertical arc in which the arm 48 moves in generally coplanar with the downward arcuate path of the starter bar and the strand. The rotational motion of the drive 36 is also transferred by way of reducer 37 through coupling 38 and gear box 40 to a second horizontal shaft 52. A second clutch 54 is provided to selectively stop the motion of shaft 52. By means of a reducing, braking and torque limiting apparatus 56, the speed of the rotational motion of shaft 52 is reduced and transferred to a second arm member which is shown generally at numeral 58. Arm 58 pivots on pivoting shaft 60 through a vertical arc which is generally coplanar with the starter bar receiving structure 28. A more detailed explanation of the workings of the arms 48 and 58 is included below.

Still referring to FIG. 1, it will be seen that through universal joint 62 and gear box 64 the drive means 36 and reducer 37 drives a shaft 66 on which there rotates a sprocket 68. This sprocket 68 drives a chain 70 which in turn rotates a second sprocket 72 on shaft 73. Sprocket 72 also drives a second chain 74 which rotates a third sprocket 76 so as to drive shaft 78 and attached roller 80. Shaft 78 is terminally mounted at one end to rotate on bearing 82 and at its other end to a second similar bearing (not shown). It will also be observed that the straightener apparatus includes a idler roller 84 which is positioned in opposition to the drive roller 80. The idler roller is also positioned at the terminal end of arm 86, and arm 86 pivots vertically at its other end on shaft 73. Disconnecting roller 88 is also pivotally connected to the terminal end of an arm 90 which also pivots vertically on shaft 73. Arms 86 and 90 are connected to and their movements are controlled, respectively, by hydraulic piston and cylinder combinations 92 and 94. The straightener apparatus also includes a base support 96, vertical frame members as at 98 and 100 and upper frame members as at 102.

It will also be seen from FIG. 1 that the first pivoting arm member consists of an upper arm section 104 and a lower arm section 106 which is pivotable on a pin 108 with respect to the upper arm section 104. At the terminal end of the lower arm section is a starter bar engaging protrusion 110 which is inserted into a recess 112 in the starter bar 12. It will be observed that there is also a second recess 113 where arm 58 engages the starter bar. Also projecting from the lower arm member is a guide engagement protrusion 114 which has at its terminal end a wheel 116. A guide structure 118 is suspended from the supporting structure (not shown) of the continuous casting machine. As is explained in greater detail below, the protrusion 114 engages and runs along this guide to control the motion of the arm 48. A limit switch 120 mounted on guide 118 controls clutch 44. The arm 58 also includes an upper arm section 122 and a lower arm section 124 which are pivotally connected at pin 126. At the terminal end of lower arm section there is a starter bar engagement protrusion 128 which is insertable into recess 113 of the starter bar 12. The lower arm section 124 also is characterized by a guide engagement protrusion 130 with a wheel 132 at its terminal end which abuts a guide shown in fragment at 134 and suspended from the continuous casting machine structure. Other limit switches 135, 136, 138 140 and 142 control the arms 48 and 58 in a manner hereafter described.

From FIG. 1 it will also be seen that the starter bar 12 will be withdrawn from the mold 10 by the arm 48 as the arm is pivoted downwardly toward its lower position adjacent the straightener apparatus. It will be understood that the starter bar should be moved at a constant speed. Hence it will be necessary to vary the speed of the arm by varying the speed of the main drive so that the arm's velocity is greater near the mold. The upper position of the first arm 48 where the starter bar has been initially engaged by the straightener apparatus 24 is shown in solid lines. As the first arm is pivoted downwardly from its upper position, the guide engagement protrusion 114 abuts the guide 118 and is displaced upwardly on it so that the starter bar engagement protrusion 110 is withdrawn from the recess 112 on the starter bar 12. The position of the first arm as it disengages from the starter bar is shown in broken lines at 48'. After the arm 48 has been disengaged from the starter bar 12, the arm will continue to pivot somewhat further toward the straightener apparatus until it trips the limit switch 120 which action will have the effect of activating clutch 44 to disengage shaft 42 from gear box 40 and, thereby, halt the pivoting motion of the first arm 48 at a position where its terminal end is suitably removed from the hot strand below. At this point the brake mechanism in reducing and braking apparatus 46 will also be automatically set. This first arm is shown in fragment and in broken lines in this final position at 48''. It will also be observed that as the starter bar is engaged by the rollers 80 and 84 the first arm will be disengaged from the starter bar 12. By means of the action of the rollers 80 and 84 the starter bar will be pushed past idler roller 88 to a point where the starter bar trips limit switch 135 which will cause clutch 54 to engage shaft 52 to gear box 40 and the drive means so that arm 58 will begin to pivot upwardly in a vertical arc so as to first move the engagement protrusion 128 of the arm 58 into engagement with recess 113 of the starter bar and then move the starter bar 12 upwardly on the starter bar receiving structure 28 until it reaches its storage position. The position of the second arm when the starter bar is in this storage position is shown in broken lines at 58'. On its way toward this final storage position the starter bar trips limit switch 136 which causes piston and cylinder combination 94 to expand and arm 90 to pivot downwardly to remove the starter bar from the strand in a conventional manner as is, for example, described in U.S. Pat. No. 3,628,595. As is also conventional, the straightened strand is then discharged from the straightener apparatus 24 to the casting take-off table 26. It will also be noted that when the starter bar trips switch 136 the shaft 42 is reengaged with the gear box 40 and the first arm pivots upwardly to its original position as at 48. When the starter bar trips limit switch 138, clutch 54 will be activated to disengage shaft 52 from the gear box 40. At this point the brake mechanism in reducing and braking apparatus 56 will also be automatically set.

The action of the starter bar handling mechanism of the present invention in returning the starter bar 12 from its storage position to the mold is essentially opposite from that described above. The arm 58 is pivoted downwardly until the starter bar 12 is engaged by the opposed rollers 80 and 84. It will be noted that the vertical centerline of these rollers is equidistant from the positions of the terminal ends of the arms 48 and 58 in their upper extended positions. The arm 58 is then disengaged from the starter bar 12 and the rollers 80 and 84 displace the starter bar to a point where it is engaged by the arm 48. Arm 58 continues to pivot toward the straightener apparatus until it trips limit switch 140 which causes clutch 54 to disengage shaft 52 from gear box 40 and engage shaft 42 with gear box 40. The rotation of shaft 42 will cause arm 48 to rotate upwardly until it reaches its upper position shown in FIG. 1 and the starter bar is inserted in the mold. At this point limit switch 142 will be tripped by arm 48 to stop the main drive.

Figure 3:
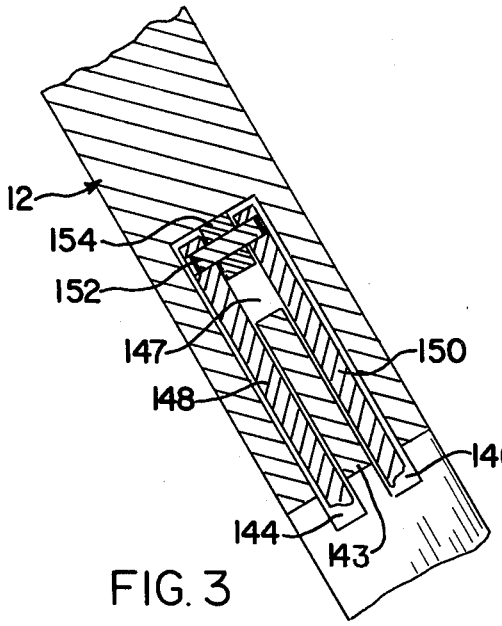
FIG. 3 is a cross sectional view taken through line III—III in FIG. 2.
Figure 2:
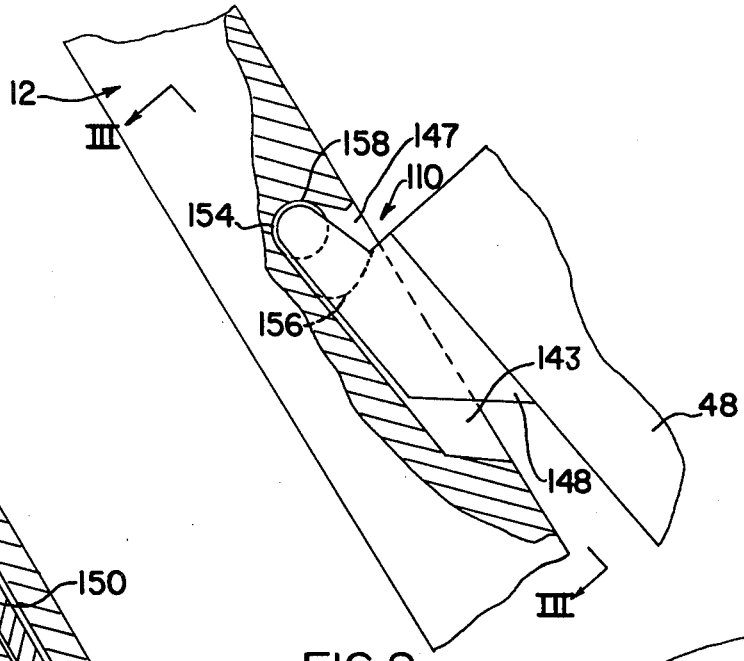
FIG. 2 is an enlarged cut away view of the area within Circle II of FIG. 1.
Figure 4:
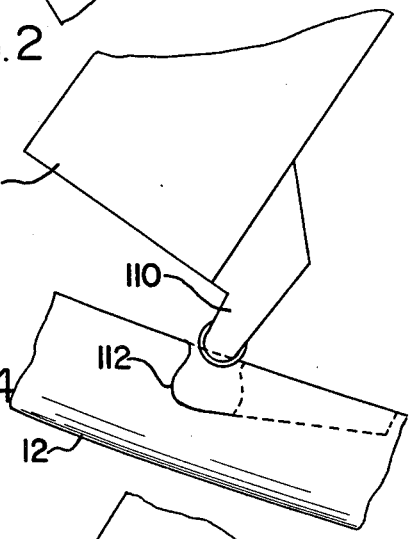
FIG. 4 is an enlarged view of the area within Circle IV in FIG. 1.

The elements of the starter bar engagement protrusion 110 are shown in greater detail in FIGS. 2 and 3. From these figures it will be seen that the recess 112 on starter bar 12 is divided by a raised medial partition 143 into two lateral sections 144 and 146 and a wheel receiving space 147. It will also be observed that the terminal projection is bifurcated and that its two prongs 148 and 150 are received, respectively, by the lateral sections 144 and 146. A pin 152 connects the terminal ends of the prongs 148 and 150 and a wheel 154 rotates on this pin. It will be observed that this wheel 154 is received in space 147 and bears against a curved surface 156 on the starter bar and may also be received by a curved surface 158 on the medial partition 142 which is opposed to said surface 156. As the arm 48 pivots downwardly on pivoting shaft 50 and moves the starting bar with it, the arm will also pivot on pin 152 in recess 112 so that the prongs 148 and 150 of the starter bar engagement protrusion 110 are gradually raised upwardly out of engagement with the lateral sections 144 and 145 of the recess 112. As is shown in FIG. 4, the angular displacement between the starter bar 12 and the starter bar engagement protrusion will increase until the arm disengages from the bar.

Figure 6:
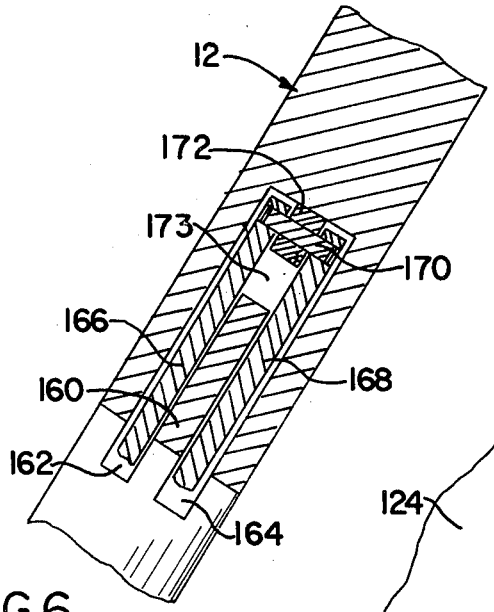
FIG. 6 is a cross sectional view taken through line VI—VI in FIG. 5.
Figure 5:
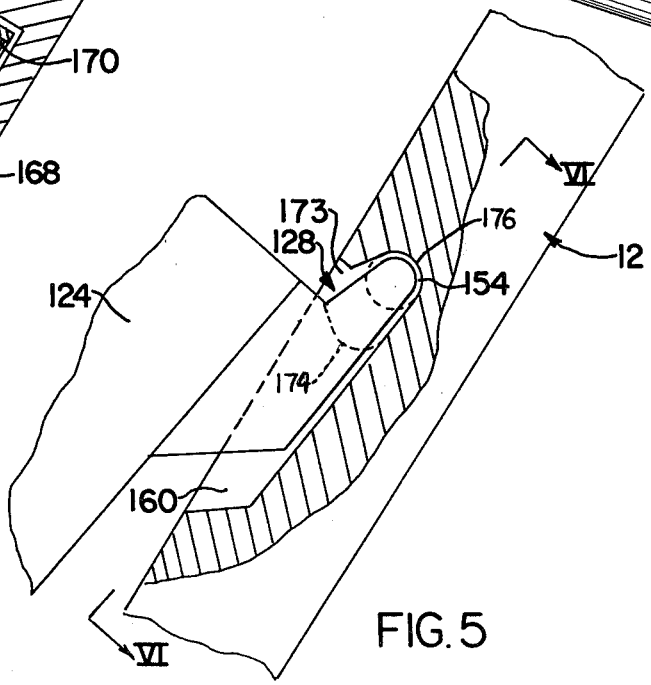
FIG. 5 is an enlarged view of the area within Circle V in FIG. 1.

As is shown in FIGS. 5 and 6, the starter bar engagement protrusion 128 on arm 58 and recess 113 on the starter bar are similar to protrusion 110 and recess 112 in construction but oppositely oriented. Recess 113 has a medial partition 160 that divides it into two longitudinal lateral sections 162 and 164. Protrusion 128 has two prongs 166 and 168 that are received in these lateral sections. These prongs are connected by a pin 170 on which there is mounted a wheeel 172 that pivots in a wheel receiving space 173 between curved surface 174 on the partition and curved surface 176 against which it bears when the starter bar is in its storage position.

Figure 7:
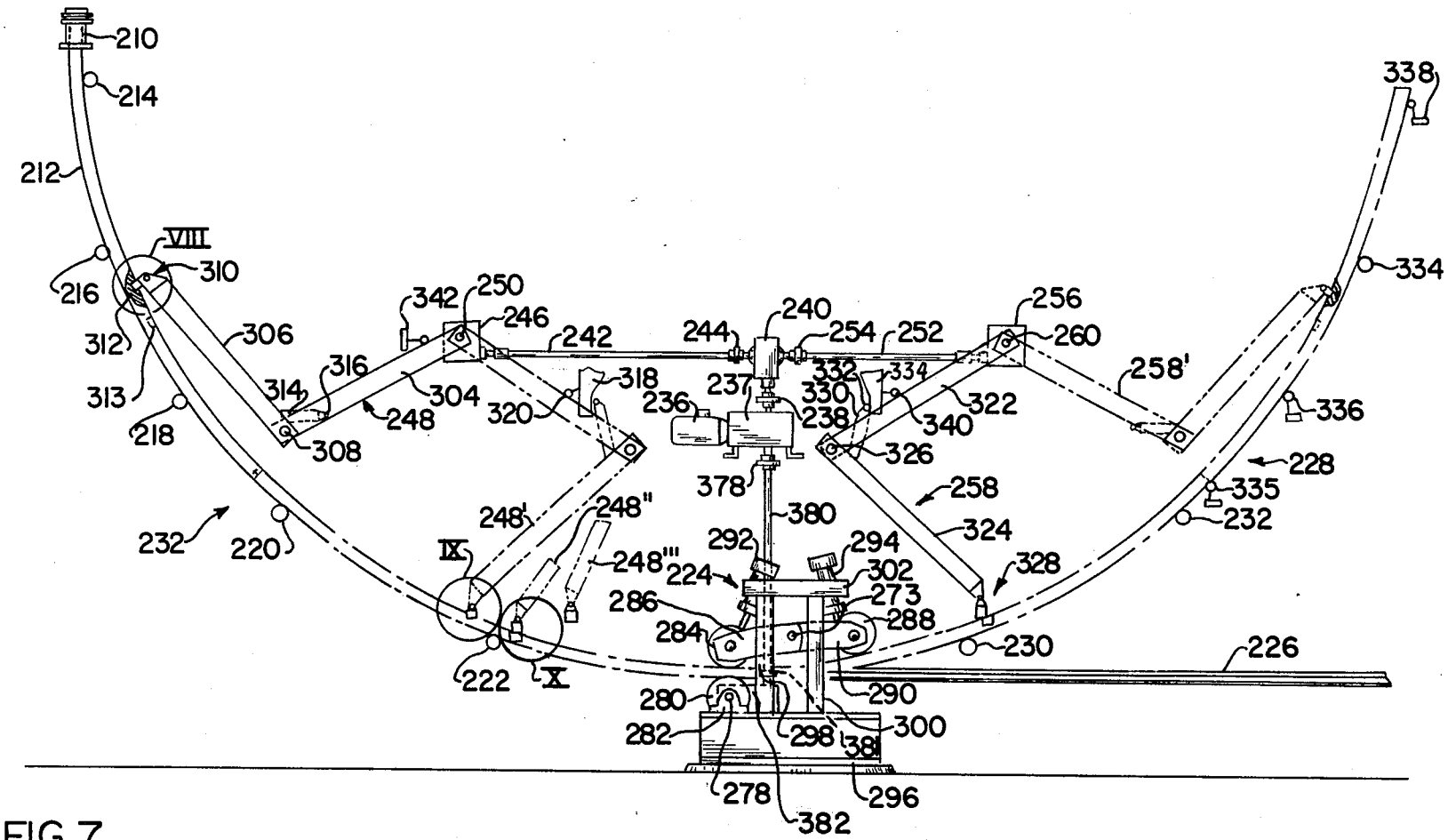
FIG. 7 is a schematic elevational view of a continuous casting machine representing another embodiment of the present invention.

A second embodiment of the present invention is shown in FIGS. 7–10. Referring particularly to FIG. 7, it will be seen that like the first embodiment described above, this second embodiment includes a conventional flow through mold 210 along with mold support, oscillation and spray means (not shown). A starter bar 212 is shown inserted in the mold, and a plurality of guide rollers as at 214, 216, 218, 220 and 222 define a downward, generally arcuate strand conveying structure shown generally at numeral 223. This strand conveying structure has a lower discharge end oriented in a substantially horizontal direction. Adjacent this discharge end is a straightener apparatus 224. Extending laterally from the discharge end of the straightener apparatus is a casting take-off apparatus 226, and curving upwardly and away from this discharge end is a starting bar receiving structure 228 which includes guide rollers 232 and 234. A conventional support structure is also provided, but is not shown.

The mechanism for handling the starter bar 212 includes a main drive means 236 which is preferably an alternating current electric motor. This motor is connected through reducer 237 to a coupling 238 and a gear box 240 so as to rotate a horizontal shaft 242. Clutch 244 is provided to selectively stop rotation of this shaft. The rotational motion of the shaft 242 is transferred through a reducing and selective braking apparatus 246 to drive a first arm, shown generally at numeral 248, which pivots through a vertical arc on a pivoting shaft 250. The vertical arc in which the arm 248 moves is generally coplanar with the downward arcuate path of the starter bar and the strand. The rotational motion of the motor 236 is also transferred by way of reducer 237 through coupling 238 and gear box 240 to a second horizontal shaft 252. A second clutch 254 is provided to selectively stop the motion of shaft 252. By means of a reducing, braking the torque limiting apparatus 256, the speed of the rotational motion of shaft 254 is reduced and transferred to a second arm member which is shown generally at numeral 258. Arm 258 pivots on pivoting shaft 260 through a vertical arc which is generally coplanar with the starter bar receiving structure 228. A more detailed explanation of the working of the arms 248 and 258 is included below.

The drive means 236 and reducing gearing 237 are connected by a coupling 378, shaft 380 and a second coupling 381, to a gear box 382 which is connected to a horizontal shaft 278. This shaft 278 drives a roller 280 and is supported at one end on a bearing 282 and at its other end by a similar bearing (not shown). An opposed idler roller 284 is positioned at the terminal end of an arm 286. At its other end arm 286 pivots vertically on a shaft 273. A disconnecting roller 288 is also pivotally connected to the terminal end of arm 290 which also pivots vertically on shaft 273. Arms 286 and 290 are connected to and their movements are controlled, respectively, by hydraulic piston and cylinder combinations 292 and 294. The straightener apparatus is also supported by a base structure 296, vertical frame members as at 298 and 300 and upper frame members as at 302.

It will also be seen from FIG. 7 that the first pivoting arm member consists of an upper arm section 304 and a lower arm section 306 which is pivotable on a pin 308 with respect to the upper arm section 304. At the terminal end of the lower arm section is a starter bar engaging protrusion 310 which is inserted into a recess 312 in the starter bar 212. It will be observed that there is also a second recess 313 where arm 258 engages the starter bar. Also projecting from the lower arm member is a guide engagement protrusion 314 which has at its terminal end a wheel 316. A guide structure 318 is suspended from the supporting structure (not shown) of the continuous casting machine. As is explained in greater detail below, the protrusion 314 engages and runs along this guide to control the motion of the arm 248. A limit switch 320 mounted on guide 318 controls clutch 244. The arm 258 also includes an upper arm section 322 and a lower arm section 324 which are pivotally connected at pin 326. At the terminal end of lower arm section 324 there is a starter bar engagement protrusion which is insertable into recess 312 of the starter bar 212. The lower arm section 324 also is characterized by a guide engagement protrusion 330 with a wheel 332 at its terminal end which abuts a guide shown in fragment at 334 and suspended from the continuous casting machine structure. Other limit switches 335, 336, 338, 340 and 342 control the arms 248 and 258 in a manner hereafter described.

From FIG. 7 it will also be seen that the starter bar 212 will be withdrawn from the mold 210 as the arm 248 is pivoted downwardly toward its lower position adjacent the straightener apparatus. The upper position of the first arm 248 where the starter bar has been initially engaged by the straightener apparatus 224 is shown in solid lines. As the first arm is pivoted downwardly from its upper position, the guide engagement protrusion 314 abuts the guide 318 and is displaced upwardly on it so that the starter bar engagement protrusion 310 is withdrawn from the recess 312 on the starter bar 212. The protrusion of the first arm as it begins to disengage from the starter bar is shown in broken lines at 248'. The position of the first arm after it has just disengaged from the starter bar is shown in fragment and in broken lines at 248'. After the arm 248 has been disengaged from the starter bar 212, and arm will continue to pivot somewhat further toward the straightener apparatus until it trips the limit switch 320 which action will have the effect of activating clutch 244 to disengage shaft 242 from gear box 240 and, thereby, halt the pivoting motion of the first arm at a position where its terminal end is suitably removed from the hot strand below. At this point the brake mechanism in reducing and braking apparatus 246 will also be automatically set. This first arm is shown in fragment and in broken lines in this final position at 248''. It will also be observed that as the first arm is disengaged from the starter bar 212, the starter bar trips limit switch 335 which will cause clutch 254 to engage shaft 252 to gear box 240 and the drive means so that arm 258 will begin to pivot upwardly in a vertical arc so as to first move the engagement protrusion 328 of the arm 258 into engagement with recess 313 of the starter bar and then move the starter bar upwardly on the starter bar receiving structure 228 until it reaches its storage position. The position of the second arm when the starter bar is in this storage position is shown in broken lines at 258'. On its way toward this final storage position the starter bar trips limit switch 336 which causes piston and cylinder combination 294 to expand and arm 290 to pivot downwardly to remove the starter bar from the strand in a conventional manner. As is also conventional, the straightened strand is then discharged from the straightener apparatus 224 to the casting take-off table 226. It will also be noted that when the starter bar trips switch 336 the shaft 242 is reengaged with the gear box 240 and the first arm pivots upwardly to its original position as at 248. When the starter bar trips limit switch 338, 254 will be activated to disengage shaft 252 from the gear box 240. At this point the brake mechanism in reducing and braking apparatus 256 will also be automatically set.

As with the first embodiment, the action of the second embodiment of the present invention in returning the starter bar 212 from its storage position to the mold is essentially opposite from that described above. The arm 258 is pivoted downwardly until the starter bar 212 is engaged by the opposed rollers 280 and 284. The arm 258 is then disengaged from the starter bar 212 and the rollers 280 and 284 displace the starter bar to a point where it is engaged by the arm 248. Arm 258 continues to pivot toward the straightener apparatus until it trips limit switch 340 which causes clutch 254 to disengage shaft 252 from gear box 240 and engage shaft 242 with gear box 240. The rotation of shaft 242 will cause arm 248 to rotate upwardly until it reaches its upper position shown in FIG. 7 and the starter bar is inserted in the mold. At this point limit switch 342 will be tripped by arm 248 to stop the main drive.

Figure 8:
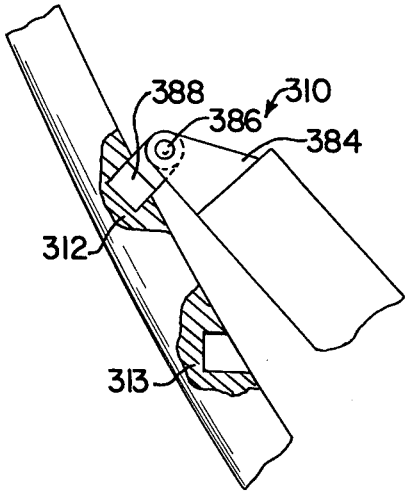
FIG. 8 is an enlarged view of the area within Circle VIII in FIG. 7.
Figure 9:
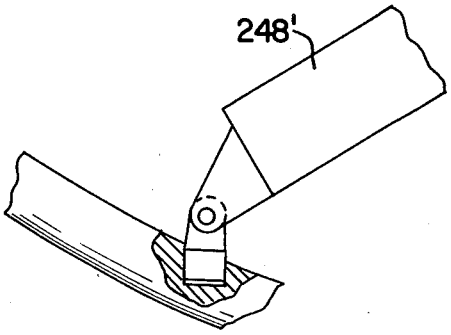
FIG. 9 is an enlarged view of the area within Circle IX in FIG. 7.
Figure 10:
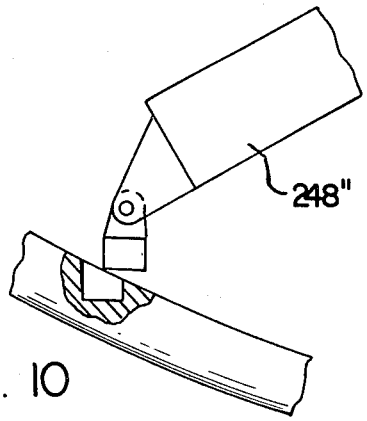
FIG. 10 is an enlarged view of the area within Circle X in FIG. 7.

The details of the starter bar engagement protrusion 310 are shown in greater detail in FIGS. 8, 9 and 10. From FIG. 8 it will be seen that the protrusion 310 includes two parallel prongs, one of which is shown at numeral 384. At the terminal end of these prongs there is a pin 386 on which there pivots a weighted end section 388. The weighted end section 388 fits the recess 312 in the starter bar. As the arm 248 pivots downwardly on pin 250 and moves the starting bar with it, the weighted end section 388 will pivot downwardly on the pin 386 until it reaches a vertical position as is shown in FIG. 9. When the weighted end section 388 reaches such a vertical position it will be lifted free of the recess 312 by the motion of the arm, as is shown in FIG. 10.

While not shown in detail in the drawings, the starter bar engagement protrusion 328 on arm 258 is similar in structure and operation to starter bar engagement protrusion 310, except that it is oriented in the opposite direction. The recess 313 is also similar but is the mirror image of recess 312. Thus, referring to FIG. 7, the weighted end section of protrusion 328 will hang vertically until it engages recess 313 where it will lodge so as to be displaced from this vertical position as the second arm pivots to its position at 258'.

It will, thus, be appreciated that there has been described a continuous metal casting machine having a starter bar handling system which effectively handles the starter bar and which is unlikely to deform or damage the metal strand and which avoids maintenance problems which have characterized a number of the starter bar handling systems heretofore known.

Although the invention has been described herein with a certain degree of particularity, it is to be understood that the present disclosure has been made only as an example and that the scope of the invention is defined by what is hereinafter claimed.

What is claimed is:

1. In a continuous metal casting machine having an elevated vertical flow through casting mold connected at its lower end to a downwardly curving strand conveying structure having a lower discharge end oriented in a substantially horizontal direction, a strand starting bar engageable with the lower end of the mold and conformable in curvature to the strand conveying structure, a strand receiving structure laterally extending from the discharge end of the downwardly curving strand conveying structure, a curved starting bar receiving structure vertically displaced above said strand receiving structure and extending upwardly and away from the discharge end of the downwardly curving strand conveying structure, and a strand straightener and starting bar advancing apparatus having at least one set of rotating roller members interposed between said discharge end of the downwardly curving strand conveying structure and said strand and starting bar receiving structures, wherein the improvement comprises:

(a) a first arm member having a fixed end that is pivotally mounted at a point vertically displaced above at least a portion of the downwardly curving strand conveying structure so that said first arm member pivots from an upper position adjacent the mold to a lower position adjacent the straightener apparatus through a vertical arc substantially coplanar with said downwardly curving strand conveying structure;

(b) selectively connectable first starter bar engagement means terminally mounted on said first arm member;

(c) control means for releasing said first starter bar engagement means when the starter bar has been engaged by the straightener apparatus;

(d) a second arm member having a fixed end that is pivotally mounted at a point vertically displaced above at least a portion of the upwardly curving starter bar receiving structure so that said second arm member pivots from a lower position adjacent the straightener apparatus to an upper storage position through a vertical arc substantially coplanar with said upwardly curving starter bar receiving structure;

(e) selectively connectable second starter bar engagement means terminally mounted on said second arm member; and (f) control means for engaging said second starter bar engagement means when the starter bar has been discharged from the straightener apparatus, such that after the starter bar has been displaced from the mold to the straightener apparatus by movement of the first arm member from its upper to its lower position and the starter bar is advanced through the straightener apparatus by rotation of the roller members, the starter bar will then be engaged by the second arm member and withdrawn to said upper storage position.

2. The continuous metal casting machine defined in claim 1 wherein a rotating drive means is suspended above the straightener apparatus and the fixed end of said first and second arm members are displaced at approximately equal horizontal distances from said drive means and wherein said drive means is connected to said fixed ends by a horizontal means for transferring rotational motion.

3. The continuous metal casting machine defined in claim 2 wherein a means for reducing the relative rate of rotational motion between said drive means and said first and second arm members is provided.

4. The continuous metal casting machine defined in claim 2 wherein the drive means is connected vertically by a means for transferring rotational motion to a horizontal shaft that is rotatably mounted at its terminal end on a pair of bearings and between said bearings one of said roller members is mounted on said shaft.

5. The continuous metal casting machine defined in claim 4 wherein the drive means is connected by reduction gearing, a universal joint and further gearing to a first sprocket which by means of a chain drives a second sprocket which by means of a second chain drives a third sprocket which drives said horizontal shaft.

6. The continuous metal casting machine defined in claim 4 wherein the drive means is connected by means of a vertical shaft which is connected by a means for changing direction of rotational motion to said horizontal shaft.

7. The continuous metal casting machine defined in claim 2 wherein the first arm member consists of an upper first arm section pivotally attached at its lower end to a lower first arm section, said lower first arm section having a first terminal protrusion that is engageable with a first recess on the starter bar and a first intermediate protrusion which engages a first guide member that is positioned so that said terminal protrusion will be withdrawn from said recess when the starter bar is engaged by the roller members.

8. The continuous metal casting machine defined in claim 7 wherein a first clutch is provided between the drive means and the first arm member and a second clutch is provided between the drive means and the second arm member and first and second limit switches are connected, respectively, in electrical circuit with said first and second clutches, and said first switch is mounted adjacent the first guide means such that after the first intermediate protrusion engages the first guide member the first clutch will be activated to disengage the first arm member from the drive means, said second switch is mounted adjacent the starting bar receiving structure such that after the starter bar has been discharged from the straightener apparatus the second clutch will be deactivated to engage the second arm member with the drive means.

9. The continuous metal casting machine defined in claim 7 wherein the second arm member consists of an upper second arm section pivotally attached at its lower end to a lower second arm section, said lower second arm section having a second terminal protrusion that is engageable with a second recess on the starter bar and a second intermediate protrusion which engages a second guide member that retains the second arm member adjacent the straightener apparatus until the starter bar is engaged therefrom and said second terminal protrusion engages said second recess.

10. The continuous metal casting machine defined in claim 9 wherein means for separating the starter bar from its following strand is included in the straightener apparatus.

11. The continuous metal casting machine defined in claim 10 wherein a second limit switch is medially disposed on the curved starting bar receiving structure, said second limit switch being connected in electrical circuit with said means for separating the starter bar from its following strand such that said means will be activated after the starter bar is discharged from the straightener apparatus.

12. The continuous metal casting machine defined in claim 7 wherein the first terminal protrusion comprises a pair of parallel, longitudinal prongs connected by a transverse, terminal pin having a coaxial wheel member rotatively mounted thereon and wherein the first recess is divided by a longitudinal medial raised section into a pair of longitudinal lateral prong receiving sections communicating with a wheel member receiving space having a curved wall opposed to said prong receiving sections such that said wheel member bears against said curved wall and rotates about said pin as said prongs are lifted out of engagement with said longitudinal sections as the first arm member is moved downwardly from its upper position until after the first intermediate protrusion engages the first guide member so as to withdraw the wheel member from the wheel receiving space.

13. The continuous metal casting machine defined in claim 12 wherein the second terminal protrusion comprises a pair of parallel, longitudinal prongs terminally connected by a transverse terminal pin having a coaxial wheel member rotatively mounted thereon and wherein the first recess is divided by a longitudinal medial raised section into a pair of longitudinal lateral prong receiving sections communicating with a wheel receiving space having a curved wall opposed to said prong receiving sections such that said wheel member is placed into engagement with said wheel receiving space when the starter bar is discharged from the straightener apparatus and bears against said curved wall and rotates on said pin so that the prongs are displaced into engagement with the prong receiving sections as the second arm member is moved upwardly.

14. The continuous metal casting machine defined in claim 7 wherein the first terminal protrusion comprises a pair of parallel longitudinal prongs terminally connected by a transverse pin on which a weighted end section is pivotally mounted and wherein said weighted end section is engageable with the first recess and the first recess is aligned such that it is vertically disposed when the starter bar is engaged by the straightener apparatus so that after the first arm is moved downwardly from its upper position the weighted end section will be removed from the first recess after the first intermediate protrusion engages the first guide member.

15. The continuous metal casting machine defined in claim 14 wherein the second terminal protrusion comprises a pair of parallel, longitudinal prongs terminally connected by a transverse pin on which a weighted end section is pivotally mounted and wherein said weighted end section is engageable with the second recess and the second recess is aligned such that it is vertically disposed when the starter bar is discharged from the straightener apparatus so that weighted end section will be engaged with the second recess after the starter bar is discharged from the straightener apparatus and will be retained therein as the second arm member is moved upwardly.

* * * * *